US005362288A

United States Patent [19]

Razon

[11] Patent Number: 5,362,288

[45] Date of Patent: Nov. 8, 1994

[54] DEVICE FOR ASSISTING RUNNING, WALKING OR JUMPING

[76] Inventor: Eli Razon, 200 Cherokee Cir., Ambler, Pa. 19002

[21] Appl. No.: 37,242

[22] Filed: Mar. 26, 1993

[51] Int. Cl.[5] ..... A63B 5/16

[52] U.S. Cl. ..... 482/51; 482/74; 482/77; 601/35

[58] Field of Search ..... 482/51, 77, 79, 121, 482/124, 66, 67, 74, 122, 125; 128/25 R; 602/23; 623/27–29; 135/82, 84, 86; 601/33, 34, 35

[56] References Cited

U.S. PATENT DOCUMENTS

| | | | |
|---|---|---|---|
| 406,328 | 7/1889 | Yagn | 482/51 X |
| 420,179 | 1/1890 | Yagn | 482/51 |
| 843,478 | 2/1907 | Muller . | |
| 2,644,248 | 7/1953 | Seligman | 36/7.5 |
| 4,408,600 | 10/1983 | Davis | 128/80 |
| 4,450,832 | 5/1984 | Waddell | 128/80 |
| 4,728,103 | 3/1988 | Fulton | 272/137 |
| 4,872,665 | 10/1989 | Chareire | 601/35 X |
| 4,955,608 | 9/1990 | Dougherty et al. | 273/29 |
| 5,011,136 | 4/1991 | Rennex | 482/51 |
| 5,062,642 | 11/1991 | Berry et al. | 273/183 |

FOREIGN PATENT DOCUMENTS

| | | |
|---|---|---|
| 2230963 | 11/1990 | United Kingdom . |
| 977001A | 11/1982 | U.S.S.R. . |

*Primary Examiner*—Richard J. Apley
*Assistant Examiner*—John Mulcahy
*Attorney, Agent, or Firm*—Joel E. Oshtry

[57] ABSTRACT

A device for assisting a runner, walker, or jumper comprising an elongated biasing means such as a flexible pole, torsional spring, or coil spring, etc., having a handle at its top end and a shoe extension including a flexible bridge having one end swingably attached to the user's footwear and another end swingably attached to the ground end of the biasing means. The impact of a landing stores energy in the biasing means which is then returned to assist in the movement of running walking or jumping.

19 Claims, 7 Drawing Sheets

DEVICE FOR ASSISTING RUNNING, WALKING OR JUMPING

BACKGROUND OF THE INVENTION

1. Field of the Invention

This invention relates generally to devices concerned with assisting human beings in exercise or physical activities such as running, walking or jumping. More particularly, the invention relates to a device enabling a person to run, walk or jump with less expenditure of energy and less stress throughout various parts of a person's body.

2. Description of Prior Art

Running, walking and jumping all involve certain common motions which can be divided into two key parts. One part involves an upward movement in which an individual's center of gravity is raised thereby increasing the body's potential energy. A second part can be described as a downward movement in which the leg or legs and foot or feet land back on the ground. The leg or legs absorb the potential energy as the center of gravity is lowered. During a complete cycle of a body's movement in running, walking or jumping, the center of gravity will be raised or lowered. Energy is used both to raise the body's center of gravity and to counteract the body's momentum as it returns to the ground. The degree of vertical displacement of the center of gravity is generally greater in jumping than in running or walking and greater in running than in walking.

There are devices which assist or augment the upward or downward movement of the center of gravity in running, walking and jumping. Shoes have been designed to reduce impact and obtain energy absorption. Devices are known which aid individuals in exercise activities by supporting an individual's weight or weight of a part of the individual's body. Devices are known which help support a particular position assumed by an individual when engaging in athletic activities or in training for athletic activities. Examples believed to be indicative of such devices are taught by U.S. Pat. Nos. 4,408,600, 4,450,832, 4,955,608, 5,062,642 and Soviet Union Patent No. 977-001.

Devices have been utilized in the past to store some of the potential energy but do not effectively return the energy to assist in the upward movement involved in running, walking or jumping. There is a need for a device which can be used for enhancing the performance of those who are physically fit as well as enabling those in need thereof to strengthen and rehabilitate muscles, tendons and joints while reducing the stress and loads upon the various body parts. There is a further need for a device which while providing exercise to the legs also provides strengthening for the arm, shoulder and back muscles.

A device which is effective in storing some of the potential energy that would otherwise have been lost upon the downward phase or downward movement in running, walking and jumping and exchange it for kinetic energy to assist the upward movement of such physical activities is especially useful in that it assists an individual throughout the cycle of running, walking or jumping and continually assists from cycle to repeated cycle. A device which also assists an individual in regaining potential energy by raising the user's center of gravity is also useful.

SUMMARY OF THE INVENTION

The applicant's invention effectively assists a runner, walker or jumper by storing energy during landing and returning or exchanging the stored energy into kinetic energy as the individual raises his body upward to continue with the particular physical activity (running, walking or jumping). The energy is transmitted between the individual user and the device by the hands which grip the device. The device includes a resilient or spring-like element which alternatively stores and discharges the energy thereby increasing and decreasing the potential and kinetic energy.

For the activities of running and walking it is an object of the present invention to improve the speed at which an individual runs or walks given a defined muscular or cardiovascular effort. Similarly, for jumping it is an object of the invention to increase the frequency or height of the jumps given a defined muscular or cardiovascular effort.

It is also an object of the invention to enable an individual to run, walk or jump for a longer period of time at a given speed or rate than he or she would otherwise be able to.

Thus, it is a general object of the invention to enhance the overall performance capabilities of the user.

It is a further object of the invention to reduce the stress and loads on the body's joints, muscles, bones, hip, groin, knees and spine than would otherwise be experienced in running, walking or jumping. It is also an object of the invention to reduce the impact on landing during running, walking or jumping.

It is a further object of the invention to exercise the hands and arms to a greater extent than is typically experienced during running, walking or jumping.

It is yet another object of the invention to provide a device that can be used by athletes, individuals engaged in exercise or individuals engaged in physical activity such as laborers or soldiers or other occupations which require running, walking or jumping.

In addition, it is also an object of the invention to provide a device that can be used by individuals who are in need of physical therapy or who require a reduction in stress on the joints, bones, hips, spine, knees, muscles, tendons or other parts of the body.

Furthermore, the invention is intended to provide a device for widespread use by a variety of individuals which is easy to use, efficient in operation and economical to manufacture.

These and other objects of the invention are realized by providing a device which includes an elongated, flexible, resilient biasing means such as a pole, rod, coil spring, buckling spring, torsional spring or leaf spring which is attached at one end to an extension of a shoe or sneaker located on the outer side of a shoe or sneaker and hand held at its other end by a handle affixed to the flexible biasing means. The shoe or sneaker extension has means for receiving one end of the flexible biasing means and for retaining the biasing means in the shoe/sneaker extension. The shoe extension as a whole including a flexible, resilient member and movable, swinging or pivoting connections between the flexible member and a shoe attachment and between the flexible member and the biasing means allow the shoe extension to remain substantially in contact with the ground surface as the heel of the shoe lifts off the ground. That is, the shoe/sneaker is able to independently pivot away from the shoe/sneaker extension as the heel pivots off the ground with the toe still in contact with the ground and with the extension remaining substantially in contact with the ground, usually at an impact element end of the shoe extension. This ability to independently pivot allows the runner or walker to continue in his or her stride without being impeded while obtaining the assistance of the device.

The flexible biasing means runs along the length of the user's leg from the hip area to the foot. The handle protrudes at an angle in the hip area of the biasing means. The handle is slidably adjustable along the length of the biasing means to accommodate the particular user's arm length. Energy and forces are imparted to the flexible, resilient biasing means through the hand-held handle. The arm and hand transmit a holding force through the handle in conjunction with the movement of the body downward to cause the spring to deflect and store energy. The spring can be caused to deflect and store energy by the additional movement of the arms and hands down. Likewise, the arm and hand facilitate the transfer or discharge of the stored energy from the flexed, biasing means upon the upward movement of the running, walking or jumping cycle.

When the biasing means is a flexible pole or rod, the pole or rod functions largely as a spring or buckling spring. The greater the stiffness of the flexible rod, the more the energy will be stored upon landing and discharged upon the upward movement of the user. The degree of stiffness of the flexible pole is determined largely by the force the user is able to exert upon the rod itself. The force exerted upon the pole is determined largely by the weight of the user and the arm and hand strength of the user. The user has to be able to cause the pole to flex to a sufficient degree to store the potential energy upon landing. If the user is unable to flex the rod upon landing or only to a limited extent, energy that could otherwise have been stored and returned to assist the user's upward phase of the cycle will be lost.

However, during the use of the device, the pole is to be flexed to only a limited extent. The material composition of the rod has an inherent, limited, maximum tensile strength. This limited, maximum tensile strength necessitates that the rod be flexed only within its elastic range. Thus, the stiffness or flexibility of the rod used by an individual in the course of physical activity must take into consideration the range of forces to be exerted by a particular individual to ensure that the rod flexes within its elastic range. Different materials can be used to obtain poles with different elastic ranges and maximum tensile strengths. It is to be understood that the material composition of a flexible pole, the length of the pole and cross-sectional shape and size will all determine both the stiffness/flexibility of the rod and its elasticity.

The forces which develop upon the vertical descent of an individual's center of gravity during running, walking or jumping are largely transmitted by a connection from the user's body to the flexible biasing means. The force exerted by the user upon the flexible pole causes the pole to flex and thereby store the potential energy. This force is transmitted to the flexible biasing means through the hand-held handle. The potential energy that would normally be dissipated upon the landing phase of running, walking or jumping through the body's muscles, joints and other parts of the body is instead transferred, at least in part, by the muscles, joints and other parts of the body to the flexible biasing means of the device. In order for this energy to be stored and transferred, it is to be understood that muscle tautness and stiffness of the user is to be employed to ensure efficient transfer of the potential energy.

Since the vertical displacement of a user's center of gravity is greater during running than during walking it should be understood that the benefits of storing, absorbing and transferring energy are more marked when the device is used in connection with running rather than walking.

The handle is located near the top of the flexible rod in the hip area so that when held in the hand by the user at rest, the arm is only slightly or moderately bent. The direction of the handles define the flexing plane of the biasing means when it is flexed. In the case where a pole or rod is used for the biasing means, the cross-sectional shape of the flexible pole/rod can be significant. The handle can be slideably adjusted along the flexible pole to accommodate the height and arm length of a particular user.

The shoe extension is attached to the user's footwear at one end and at another end has means to receive and retain the end of the flexible biasing means. In one embodiment of the invention the shoe extension contains an impact element at one end which has means for receiving and retaining the biasing means. The impact element helps provide cushioning of impacts and helps provide a fixed, consistent impact point upon landing and helps keep the biasing means from slipping or moving away from the impact point. The receiving and retaining means can also provide the flexible biasing means with the capability to rotate toward or away from an individual during the cycle of running or walking. The receiving and retaining means of the shoe extension can function to reduce stress between the pole and shoe extension. The extension is designed to allow the heel to be raised while the extension remains pressed to the ground by the pressure of the flexible biasing means upon the extension. When the toe of the footwear is raised off the ground, the extension is returned to a position substantially coplanar with the sole of the shoe.

In another embodiment the shoe extension does not have an impact element at one end but means to attach to the ground end of the biasing means. In such an embodiment the ground end of the biasing means may be integral with the impact element or elements.

The shoe extension can be an integral part of the shoe itself or it can be attached by screws, lashing, straps, tacks, nails, staples or other fastening means. The optimum point for the location of the shoe attachment is from the toe joint forward.

During the landing phase of running or walking, the heel and shoe extension land on the ground followed by the entire foot, after which the energy released in landing is stored in the flexed biasing means by transmission through the tensed, tightened muscles and hands. As the body moves forward, the biasing means is rotated slightly. To initiate the upward phase of running or walking, the heel is lifted off the ground while the toe part of the foot and shoe extension remain pressed to the ground. As the heel progresses to lift off the ground and the foot as a whole lifts off the ground, the pole straightens out and the pressure on the hands and arms is released. As the flexed biasing means straightens out, it provides an upward and forward force thereby enabling an individual to exert less muscular-skeletal or bodily force during running and walking.

The upward force exerted by the straightened biasing means increases the potential energy of the user by raising his center of gravity. As the cycle of running or walking continues onto the downward phase of running or walking, the flexed biasing means stores some of the forces that would otherwise be absorbed by the body. By reducing these forces upon the body, the flexed biasing means lessens stress on various muscles, bones, joints, knees and other parts of the body. Similarly, the device can be used to assist the individual in jumping by absorbing the impact upon landing, storing some of the energy that would otherwise be dissipated upon landing and returning that energy as the individual jumps up again thereby augmenting the jump.

Throughout this application, the use of the term "shoe" will be understood to include all types and manner of footwear, including but not limited to sneakers, athletic shoes, training shoes, boots, sandals, shoes and the like.

It should be understood that the desription of the use of the device includes the use of the device with either the right or left leg or with both legs. The designation "impact element" includes impact elements that comprise one or more pieces that are either connected or unconnected to one another. The "outside of a leg" or the "outer side of a person's leg" is used to denote that side of a leg facing away from a person's body as opposed to facing towards the other leg. The "outer side of a shoe" is used to denote that side of a shoe which faces away from a person's body as opposed to facing towards the other shoe.

DETAILED DESCRIPTION OF THE PREFERRED EMBODIMENT

Figure 1:
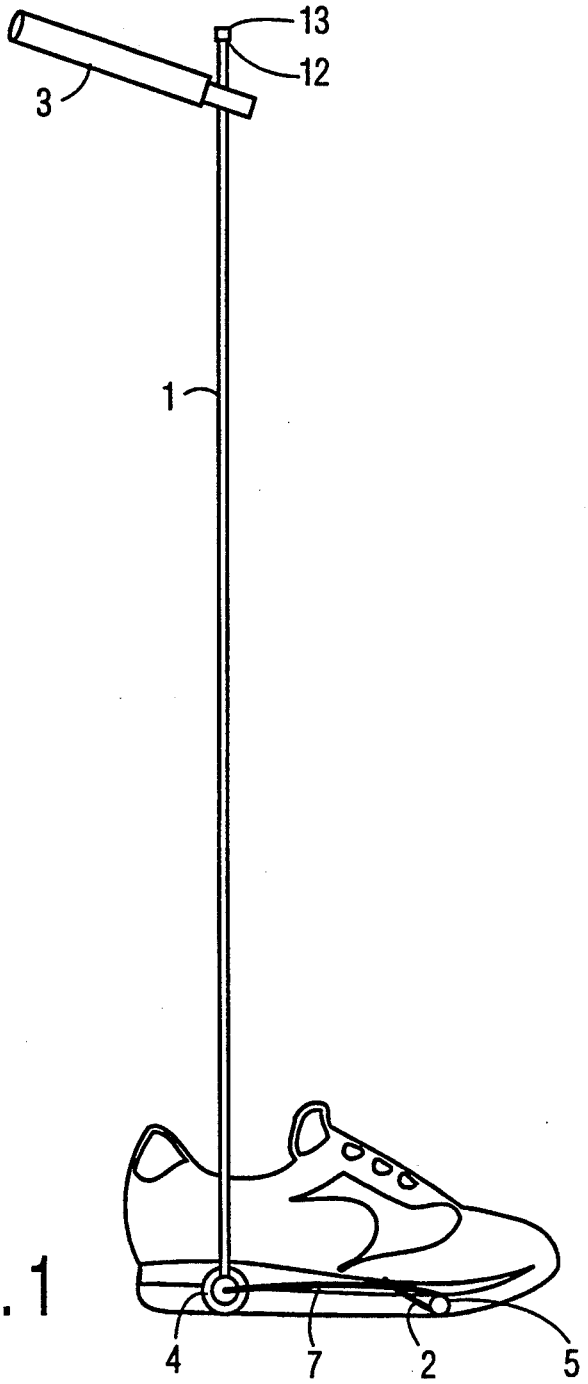
FIG. 1 is a side plan view of the device for running walking or jumping.
Figure 2:
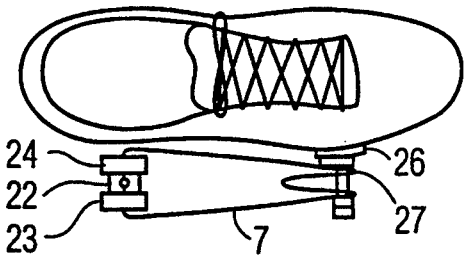
FIG. 2 is a top view of a shoe and the shoe extension.

With continued reference to the drawings, the device for assisting running, walking or jumping, as shown in FIG. 1 includes an elongated pole 1 which extends from a ground end where it is attached to a shoe extension 2 to a top end 12 below which is a handle 3. The elongated pole 1 passes through the handle 3. The handle 3 is slidably adjusted along the length of the pole 1. The ground end of the elongated pole 1 includes impact elements 4. The ground end of the pole is connected to an end of the shoe extension 2. The shoe extension 2 is attached or affixed at its other end, attachment end 5, by attachment means 6 to a shoe. A connecting flexible pivoting bridge 7 on the shoe extension 2 connects the attachment means 6 to the ground end of the pole.

Figure 3:
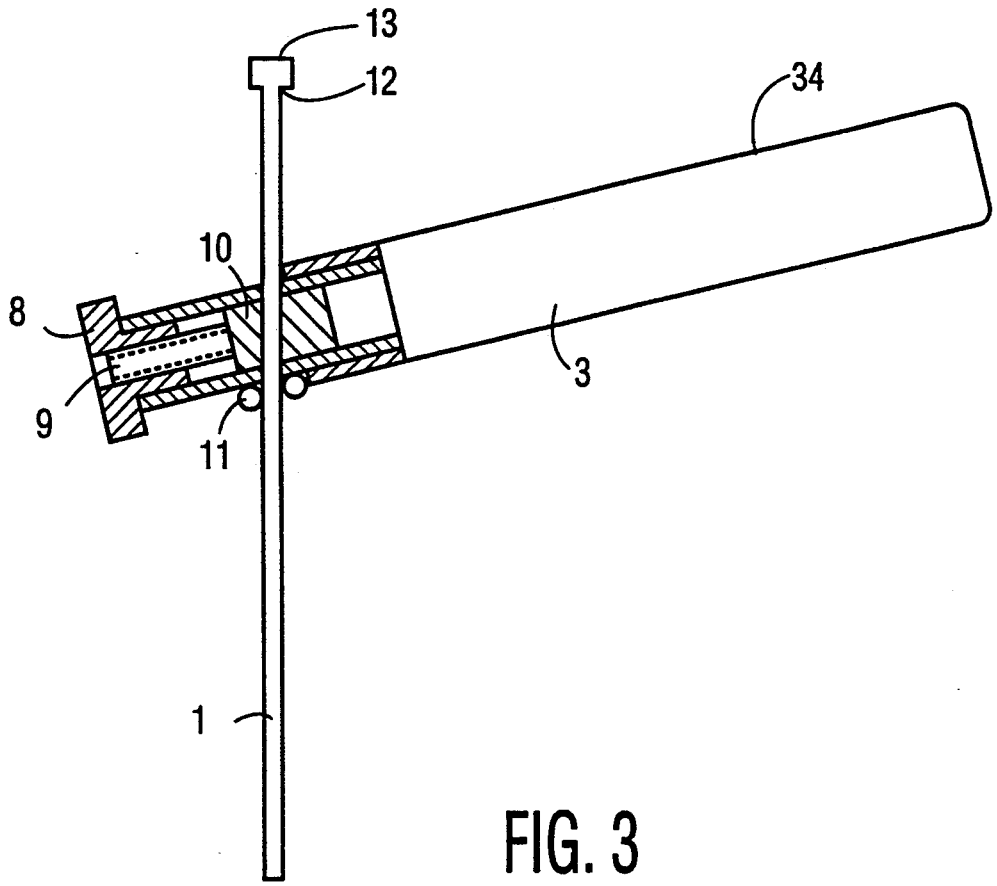
FIG. 3 is a side plan view of a partial cross-section taken along the length of the handle of the device for running, walking or jumping.
Figure 4:
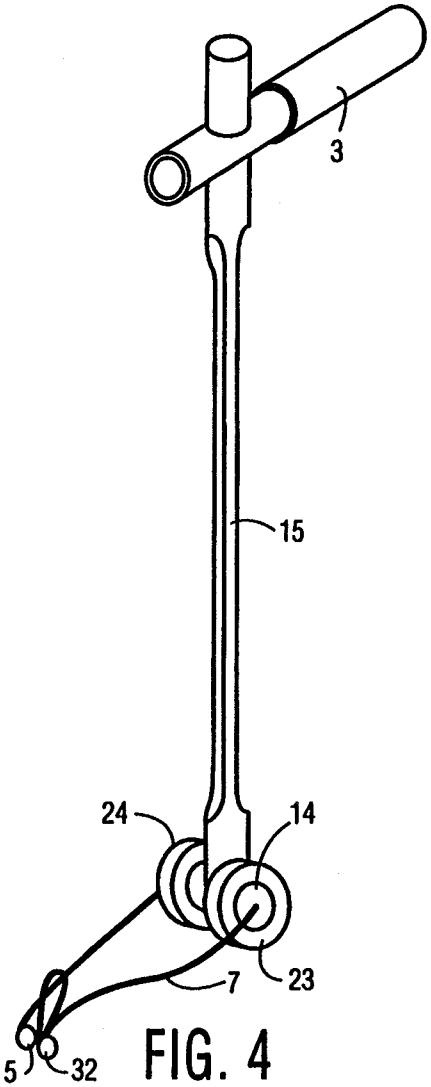
FIG. 4 is a perspective view of the device with a biasing means in the form of a flexible pole.

The handle 3 as shown in FIG. 3 is slidably adjustable along the length of the pole to accommodate the height and arm length of different users. The handle 3 can be rotated about the pole to a desired position so as to obtain a particular bending direction or flexing plane with respect to the cross-section of the pole. Depending on the bending direction, a pole with a non-circular cross-section will have varying degrees of stiffness. As shown in FIG. 4, the handle 3 entirely surrounds the pole 1 with portions of the handle 3 on both sides of the pole 1. While this is a preferred embodiment, the invention also includes within its scope, handles which terminate at one end with an attachment to the elongated pole 1. As shown in FIG. 3, the handle may include a tubular cavity to receive a locking nuts 8 and plunger screw 9. The handle can be fixed or locked against the pole by locking nuts 8 (FIG. 3). When these locking nuts are tightened, the plunger screw presses a plunger 10 against the pole, locking the pole in place. Alternatively, a rubber-stop ring 11 can be used to give the handle self-locking capability. That is, upon force being applied to the handle, the pole is locked into place. Rubber stop rings can be positioned along the pole above the handle to keep the handle from sliding up the pole. The hand-held portion 34 of the handle can be covered with a rubber or foam-like material for softness and shock absorption to the hand. The handle and pole can be positioned against one another at a pre-determined angle such as an acute angle or at right angles. In a preferred embodiment the handle is placed at an angle to the pole so that when the pole is buckled the handle moves to an angle substantially parallel to the ground surface. This prevents the handle from being manuevered into an angle which drops the hand too far down, thus impeding the forward and upward movement. The location where the handle and pole are held against one another acts as a fulcrum. Thus, the longer the handle, the greater the mechanical advantage or torque that can be applied for a given pressure in order to buckle or flex the elongated pole. A user's hand can be positioned at different locations along the length of the handle to vary the buckling force applied to the elongated pole and thereby vary the extent of buckling or flexing of the pole.

The elongated pole extends from the hip area to the shoe extension. As explained above, the elongated pole buckles or flexes in response to force applied to it through the hand-held handle. The pole returns to its original unflexed resting position as the pressure causing the buckling is released. Thus, the pole must possess properties of elasticity and resiliency with respect to repeated cycles of flexing and unflexing and a range of forces causing different degrees of flexing. The pole itself is to be made from materials which have high tensile strength and a relatively low modulus of elasticity. Such materials include but are not limited to composites of fiberglass, composites of Kevlar, composites of graphite and other materials. The thickness of the pole will affect the stiffness, tensile strength and range of elasticity of the pole. In general, increased thickness increases the stiffness of the pole as well as the tensile strength and range of elasticity. The cross-section's size and shape will determine the thickness of the pole. If the cross-section is circular (the pole being cylindrical) the thickness is constant for that particular cross-section. If the cross-section is rectangular the thickness of the pole will vary depending on the direction the pole is flexed.

In general, cylindrical poles with circular cross-sections are suitable for only limited forces where limited deflection of the pole results. For high deflection of the pole and higher forces a pole with a rectangular cross-section is more desirable.

In a preferred embodiment of the invention a cylindrical pole is used which has opposite sides shaved off to create two opposite straight-faced sides along a central portion of the rod 15 (see FIG. 4). Such a pole shape (FIG. 4) exhibits improved properties of elasticity and tensile strength.

The force at which a pole will bend is a function of the cross-sectional thickness of the pole. For a cylindrical pole with a circular cross-section the force at which the pole will bend is a function of the cross-sectional diameter. For a rectangular cross-section the force at which the pole will bend is a function of the thickness of the cross-section (in the bending plane).

The bending force is also proportional to the modulus of tensile elasticity. The bending force is inversely proportional to the square of the length of the pole. Thus, the shorter the length of the pole from its connection with the handle to its ground end, the greater the stiffness of the pole.

For a composite fiberglass pole of 33 inches length the thickness of a pole as depicted in FIG. 4 should be in the range of about $\frac{1}{4}$–$\frac{3}{8}$ inch for expected forces of 20–40 lbs.

Thus, in designing the flexible poles for use as biasing means, materials and dimensions should be adjusted to accommodate expected forces in accordance with the user's needs, weight and capabilities.

The pole or biasing means must of course be able to withstand the expected forces without losing its elasticity or breaking. The pole or biasing means must have a maximum tensile strength and yield strength above the range of forces expected to be applied to the pole.

For an example, a composite fiberglass circular pole of 33 inches in length and $\frac{3}{8}$ inches diameter which will recieve loads in the range of 30–40 lbs. can have a maximum tensile strength of about 100,000 lbs. per square inch and a modulus of elasticity of about 5,000,000 lbs per square inch.

In addition to various cross-sectional shapes that can be used for the pole 1, various different types of poles and biasing means can be employed and are within the scope of the invention. Such biasing means which can be used include but are not limited to such devices as a coil spring, buckling spring, leaf spring or torsional spring.

Figure 5:
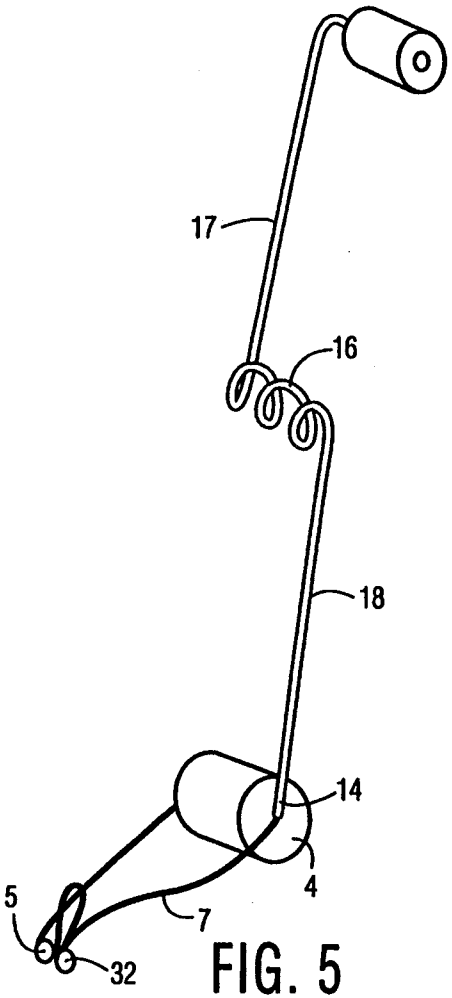
FIG. 5 is a perspective view of the device with a biasing means in the form of a torsional spring.

FIG. 5 depicts a biasing means for use with the device which is the subject matter of this application, which torsionally rotates at a centrally located torsional spring 16 in response to the application of pressure through the handle. That is, instead of being deformed into a continuous curvature the torsional biasing means as depicted in FIG. 5 has two sections 17 and 18 on each side of the torsional spring 16 around which the two sections move. The two sections substantially retain their stiffness and resistance against deforming into a curvature in response to the application of pressure. The handle to be attached to the torsional biasing means can be positioned at any direction in a 360-degree circle around the biasing means.

Figure 6:
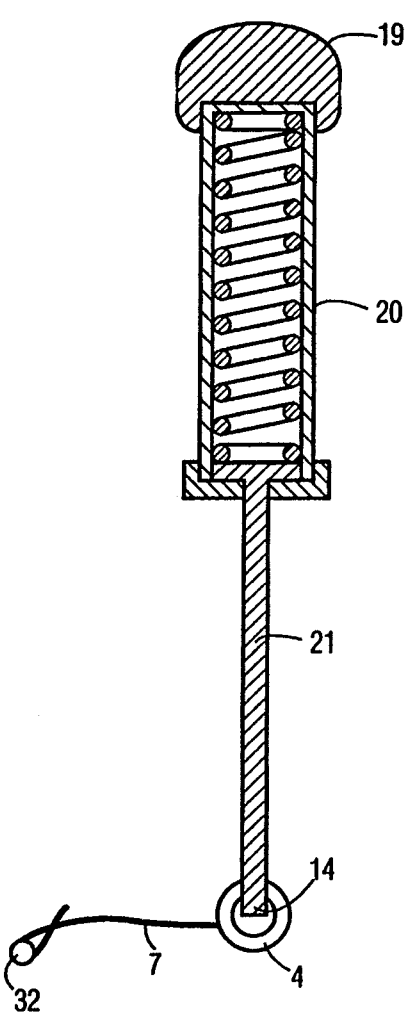
FIG. 6 is a perspective view of the device with a biasing means in the form of a coil spring.

FIG. 6 depicts another biasing means for use with the device which is the subject matter of this application. The biasing means as depicted in FIG. 6 is a compression coil spring 20. Upon the application of force by the hand and arms through the knob-like handle 19, the coil spring 20 is caused to compress, absorbing and storing energy which is returned in the upward phase of running, walking or jumping when the foot moves upward. The device utilizing a compression spring may include a rigid supporting member 21, which may be in the form of an elongated pole that is rigid, positioned between the compression spring 20 and the ground end with its impact element 4. The ground end 14 of the rigid member 21 may be cylindrically or spherically shaped to allow the device movement while being retained in the impact element 4.

When the biasing means is a pole as shown in FIGS. 1 and 4, the pole terminates at its top end 12 within, at or above the handle. If the top end 12 of the pole protrudes above the handle, the top end is covered by a pole protector 13.

Figure 7:
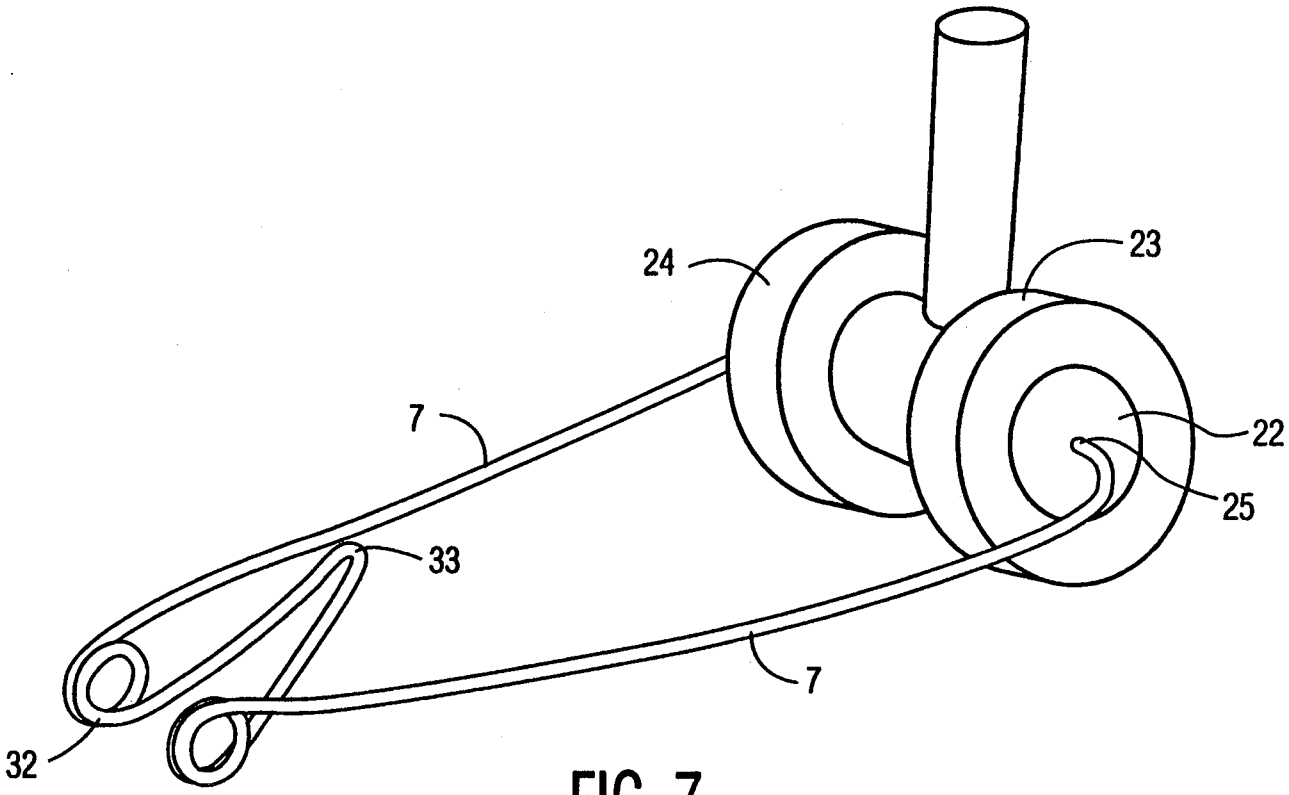
FIG. 7 is a perspective view of the flexible bridge in the form of a wire-like frame and impact elements integral to the ground end of a biasing means.

In a preferred embodiment, the ground end 14 of the pole includes a cylindrical bar 22 positioned at right angles to the pole and at substantially right angles to the length of the user's foot. Two encircling impact elements 23 and 24 encircle the cylindrical bar 22 with the vertically-extending biasing means, pole or rigid member between the encircling impact elements 23 and 24 (FIG. 7). The encircling impact elements are fixedly adhered or secured to the cylindrical bar so that the impact elements, cylindrical bar and elongated pole or biasing means are one integrated unit. The ground end 14 of the pole then is not to be removed from the impact elements 23 and 24. The impact element or elements 23 or 24 can be two separate pieces or two encircling or surrounding pieces which are connected or it can be one piece completely or partially covering the ground end of the pole or it can be located on one side of the ground end or bar. The impact element or elements 23 or 24 provide a surface which when pressed on the ground by the pressure transmitted through the pole keeps the pole from slipping or moving away from the impact point upon the ground. The circularly-shaped impact elements 23 and 24 function to give the pole or biasing means rotational capability. The rotational capability enables the top end of the pole to pivot away from or closer to the user's body. The ability of the pole to pivot about the impact element or elements 23 and 24 also reduces the stress or forces on the region of the pole near the impact element or elements 23 and 24 that would otherwise be present if the pole did not have rotational capability. When the foot is in a stationary position on the ground, the pole is pivoted slightly forward away from the body. The cylindrical bar 22 also functions to reduce the surface stress between the pole and impact element upon landing. The cylindrical bar 22 can be made from the same material or different material than the pole itself. The impact element or elements 23 and 24 need not encircle only a cylindrical bar, but may encircle any shaped bar such as a box-like bar and any other portion of the pole or biasing means so long as it comes into contact with the ground, absorbs impact and provides a fixed non-slipping impact point. The impact element or elements 23 and 24 also functions to cushion the impact upon the landing of the foot, leg and pole on the ground. The impact element or elements 23 and 24 can be made from foam, rubber or any other impact-absorbing material.

In this preferred embodiment, openings are provided on the sides of the cylindrical bar 22 or the ground end of the pole. These openings receive the ends 25 of the connecting pivoting bridge 7 where they are secured to the ground end of the pole. In general in the preferred embodiment, the shoe extension is connected to the pole or biasing means through the ends, branches or prongs, 25 of the pivoting bridge 7.

Figure 11:
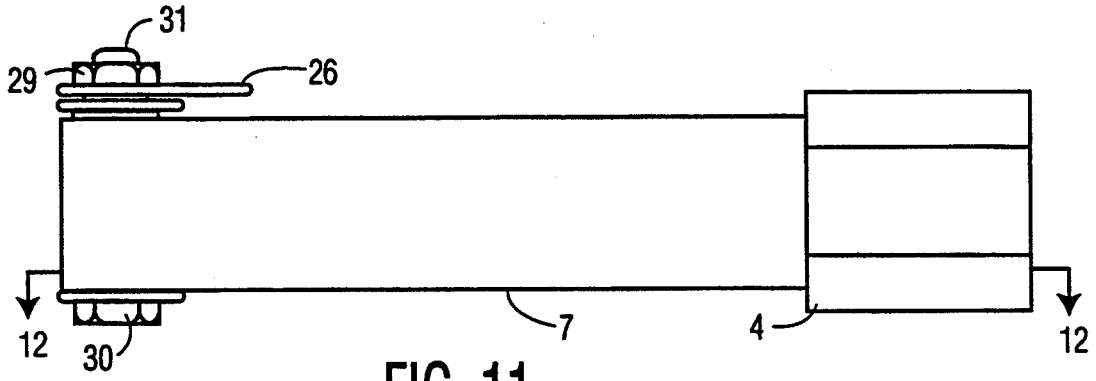
FIG. 11 is a top view of a shoe extension with a strip-like bridge.
Figure 12:
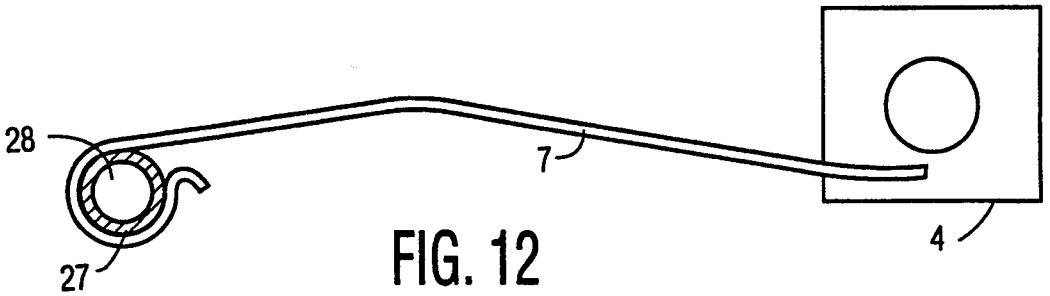
FIG. 12 is a cross-sectional side view of a shoe extension with a strip-like bridge taken along line A—A of FIG. 11.
Figure 13:
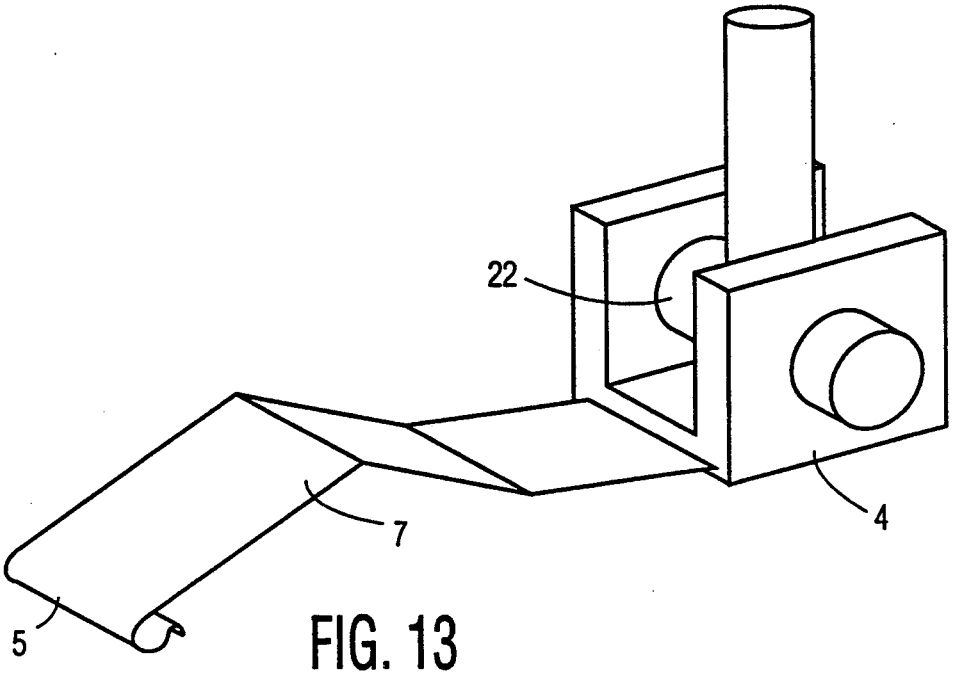
FIG. 13 is a perspective view of the flexible bridge in the form of a strip-like member and impact element integral with the shoe extension and detachable from the ground end of the pole or biasing means.

In another preferred embodiment of the invention, the ground end of the pole is not integrated with the impact element or elements 4 (FIGS. 11, 12 and 13). Rather, the ground end of the pole is inserted into and out of the impact element or elements which can be one piece or multiple pieces connected or unconnected. The ground end 14 of the pole can be cylindrical, spherical or ball-like so long as the impact element or elements 4 is adapted to receive the particularly-shaped ground end 14. When the ground end 14 is a cylindrical bar 22, it is held in the impact element 4 by a tubular cavity for receiving the cylindrical bar 22 (FIG. 13). A cylindrical or spherically-shaped ground end 14 also gives the pole rotational capability. This rotational capability allows the pole or biasing means to pivot and reduces stresses near the pole or biasing means in close proximity to the impact element or elements 4. The ground end of the pole without an integrated impact element or elements may alternatively continue to the ground end 14 with the same cross-sectional shape of the remainder of the pole and without any specially-shaped ground end. In that case, the ground end 14 of the pole can be imbedded in the surrounding material in the impact element or elements and retained by the friction of the impact element's surrounding material.

In the embodiment of the invention where the impact element is not integrated on the ground end of the pole, the impact element or elements are part of the shoe extension (FIGS. 11, 12 and 13). The pole or biasing means connects to the shoe extension through the impact element 4.

The connection between the ground end of the pole and the shoe extension in both embodiments where the impact element is integrated with the pole or biasing means and where the impact element is part of the shoe extension, is generally located adjacent to the ankle, but it can be located closer to the attachment means 6 of the shoe extension 2. The optimum point for the location of the impact element in both embodiments for running and walking is between the shoe attachment means 6 and the heel. The further away the impact element is positioned from the shoe attachment end 5, the greater the ability of the impact element to be positioned below the shoe's sole surface before the shoe lands during running, walking or jumping. The impact element will impact upon the ground before the heel of the shoe if it can be carried in a position below the surface of the shoe sole. This can be useful when the device is used to assist in jumping. For jumping then the impact element can be located in the heel area or even in the back of the heel area.

Figure 14:
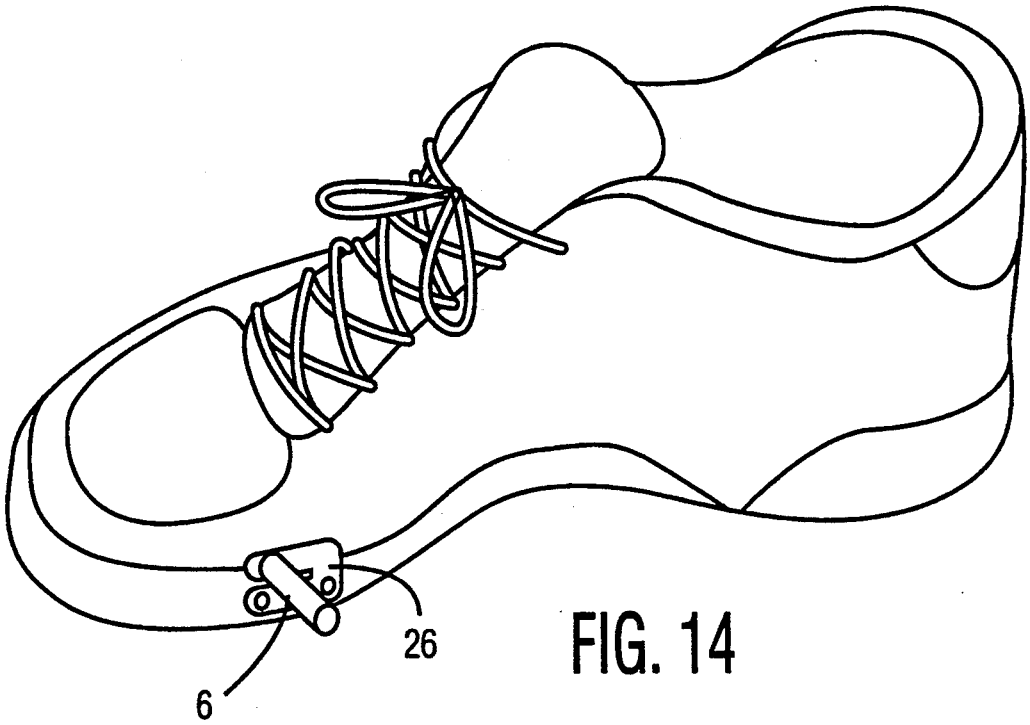
FIG. 14 is an elevational view of a shoe with a shoe attachment which is removable from the shoe.
Figure 15:
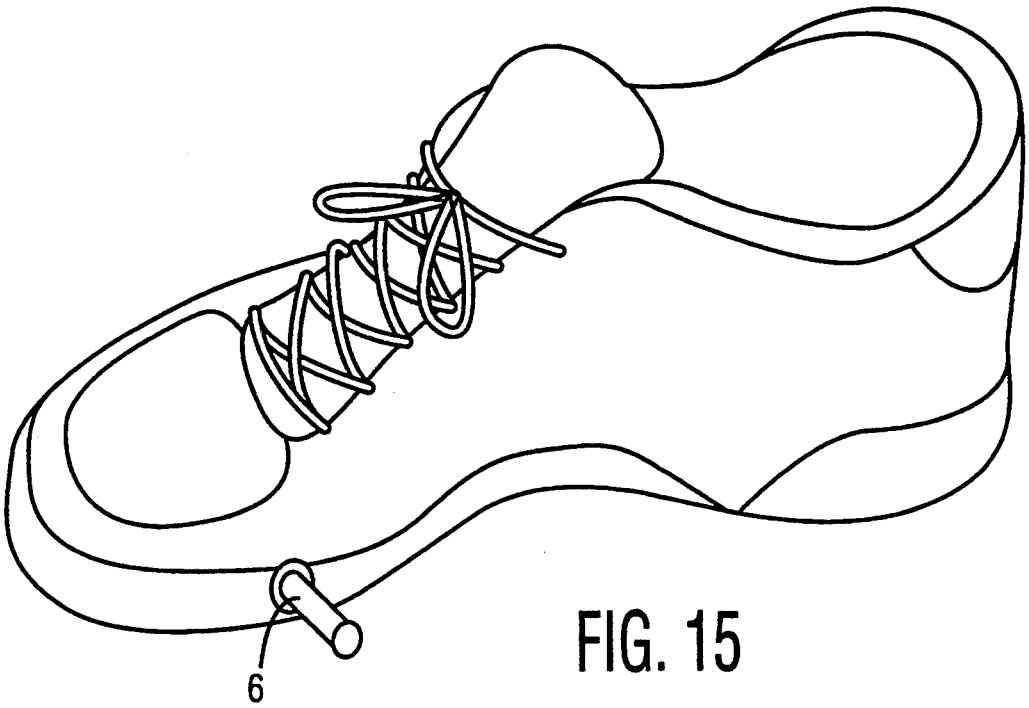
FIG. 15 is an elevational view of a shoe with a shoe attachment integral to the shoe.

The shoe extension includes a shoe attachment means 6 at an attachment end 5 and a movable, swingable or pivoting end where the shoe extension is attached to the ground end of the pole or biasing means or impact element (FIGS. 7, 9, 12 and 13). A connecting, pivoting bridge 7 extends from the shoe attachment means towards the heel of a shoe and the connection with the pole or biasing means. The shoe attachment means 6 is either a protrusion integral with the molding and material of the shoe or is fixedly secured to the shoe by fastening means such as screws, nails, staples, clips, straps, lashing, adhesives or other means. FIG. 15 shows a shoe attachment means 6 which is integral with the molding and material of the shoe. The shoe attachment means 6 which is integral with the molding and material of the shoe can be made from the same material as the shoe sole material or it can be made from different material. FIG. 14 depicts shoe attachment means 6 which is removable from the shoe so that it can be removed from the shoe and replaced on the shoe as desired. The detachable attachment means can include a metal plate 26 (FIG. 14) which is attached to the outer edge of a shoe and upon which the shoe extension can be attached or detached. A frame extending above the shoe with pins which can be used to tighten against both sides of the shoe around the sole's rim is another removable attachment means. Thus, in an alternative embodiment of the invention there is no need for a specially manufactured shoe, but rather any shoe could be adapted for use by the device with a removable shoe attachment means 6. The shoe attachment means can be made from a variety of materials, including plastic, rubber, metal, foam and other synthetic or natural materials.

The flexible, connecting, pivoting bridge 7 is to be made from a material which can swing or pivot about a pivot point located where the bridge connects to the shoe attachment end 5.

Figure 8:
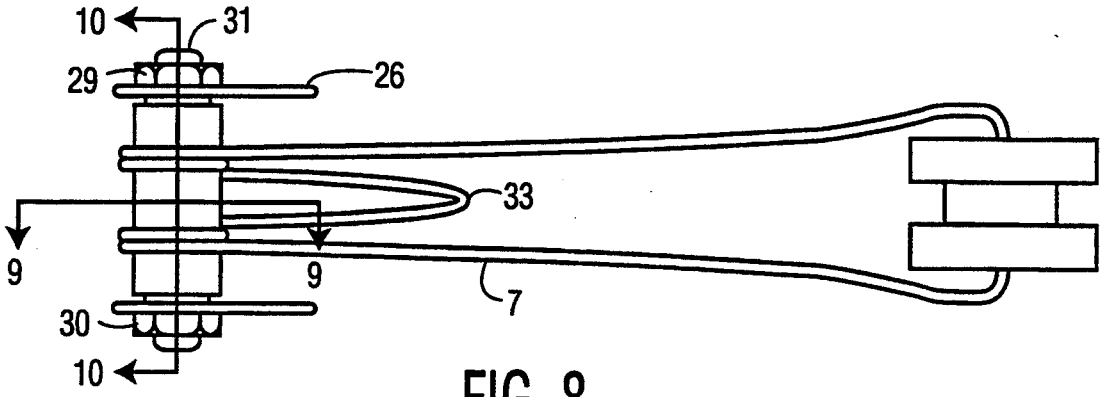
FIG. 8 is a top view of a shoe extension with a wire frame bridge.
Figure 9:
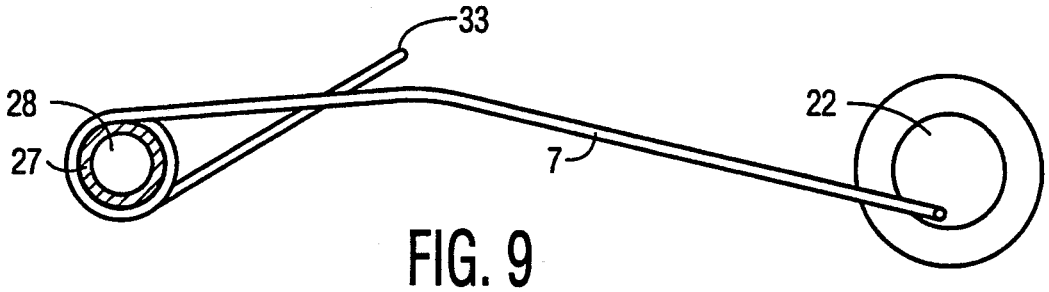
FIG. 9 is a side view of a shoe extension with a wire frame bridge with a partial cross-sectional view taken along line B—B of FIG. 8.
Figure 10:
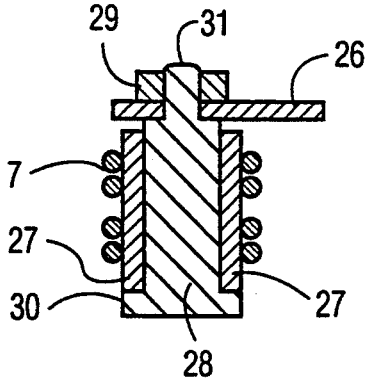
FIG. 10 is a cross-sectional view of a shoe attachment means taken along line A—A of FIG. 8.

In one preferred embodiment the connecting pivoting bridge 7 at one end can be wrapped around a roller 27 which is wrapped around a shoulder screw 28 (FIGS. 9 and 10). The shoulder screw 28 passes through a slot in the metal plate 26 and is held against the metal plate by a nut 29 which is engaged on a threaded portion of the shoulder screw 31 and by the lip of the head of the shoulder screw 30 (FIGS. 8 and 10). The roller can be wrapped around conventional type screws or bolts in which the screw or bolts pass through the metal plate and are held against the metal plate by a nut.

In a preferred embodiment, the flexible, connecting pivoting bridge 7 is in the nature of a looped wire-like frame which is under torsional tension (FIGS. 2, 7, 8 and 9). This tension secures the connecting pivoting bridge to the roller 27 or protrusion of the shoe attachment 6 in the looped region of the wire-like frame (FIGS. 8 and 9). The wire-like frame can be removed off the shoe attachment or roller and placed back on by releasing the tension in the looped region 32 (FIG. 7). The tension is released by pressing down on a pointed handle end 33 to bring the pointed handle end closer to and more in line with the wire-like frame of the connecting pivoting bridge. Pressure on the pointed handle end 33 is released to bring the looped end in torsional tension against the roller 27 or protrusion on the shoe attachment 6. The connecting bridge in the form of a wire frame can be secured to either the impact element or the ground end of the pole or biasing means which has impact elements already attached to and integral with it. In a preferred embodiment, the wire-like frame is attached to a ground end of a pole with impact elements integral to it. The connecting bridge in the form of a wire-like frame has ends turned in a direction to be received and retained in the ground end of the pole or biasing means (FIG. 7). The ends 25 of the wire-like frame can be secured to the ground end of the pole or biasing means in a variety of ways, including but not limited to being held in a cavity by friction, velcro or other binding means such as lashing, snaps or clips. Furthermore, the ends 25 of the wire-like frame can be positioned to be in a variety of directions. The ends 25 of the wire-like frame can be prong-like or branch out from the frame in a variety of shapes and directions. The attachment to the ground end of the pole or biasing means, however, should be able to allow for the easy removal and reattachment of the connecting bridge to the ground end. In this fashion, the pole or biasing means can be detached from the shoe extension and removed and stored without the shoe extension. Likewise, the shoe and shoe extension can be stored without having the pole or biasing means attached. Thus, a user can walk with the shoe without necessarily having the pole or biasing means attached. The wire-like frame can be made from metal, plastic, fiberglass or any other flexible material than can pivot about the shoe attachment means 6.

The flexible, connecting bridge 7 can be attached to the shoe attachment means by bolt, nail, screw, lashing, adhesive or other means which securely attaches the flexible connecting bridge 7 to the attachment means 6 while allowing the flexible connecting bridge to pivot about the attachment means 6.

The flexible, connecting, pivoting bridge 7 can also be in the nature of a leaf spring or a metal strip made from a metallic, plastic or other resilient material (See FIGS. 11, 12 and 13). The connecting, pivoting bridge 7 must be of limited thickness to permit bending.

The connecting pivoting bridge in the nature of a flexible metal, plastic strip or leaf spring can be connected to an impact element in which the impact element is integral with the shoe extension as shown in FIG. 12. The connecting pivoting bridge can also be a flexible wire mesh or extend partly as a metal/plastic strip until the proximity of the ground end of the pole at which point it branches out into wires, prongs or elongated projections which attach to the ground end of the pole or biasing means. Various shapes and forms and combinations of shapes or hybrids of shapes and forms for the flexible, connecting bridge can be used which can attach to a pole or biasing means with integrated impact elements or can alternatively attach to an impact element or elements directly in which the impact element or elements are part of the shoe extension itself.

The optimum point for the location of the shoe attachment end to the shoe is from the toe joint forward so as to allow the heel of the foot to lift up with the toe portion of the foot still positioned against the ground surface. Thus, the shoe attachment can be located at a position adjacent to or substantially colinear with the phalange-metatarsal joint or anterior to the phalange-metatarsal joint adjacent to the toes. The shoe attachment end then must be located so as to ensure that the heel of the foot can pivot upwards when the biasing means holds the impact element against the ground.

MODE OF OPERATION

Running and walking both involve a landing phase when the heel or foot touches the ground, an idle phase when the foot is stationary on the ground while the rest of the body moves forward and a lifting phase as the heel or foot leaves the ground. The user of the device holds the handles of the device throughout the repeated cycles of running or walking. At the time the foot or heel is landing, the impact element which holds the biasing means in place lands in a position upon the ground from which it will not move until the foot is raised. Substantially simultaneous with the landing of the foot or heel and the body's absorption of energy, some of the body's weight and landing force is transferred through the hand on the handle causing the biasing means to flex. This causes some of the force that would otherwise have been dissipated throughout the user's body to instead be stored in the flexed biasing means. As the biasing means absorbs some of the energy and the load of landing, stresses upon the body's musclo-skeletal system and organs are reduced. This reduced load and stress also allow the muscles to contract, tighten or move to a lesser extent than if they were absorbing the body's full load.

As the foot lands completely upon the ground and during the period the foot is in a stationary idle position on the ground, the body is moving forward. The hand moves the top of the biasing means forward by the handle causing it to rotate about the impact element. As the leg extends from its bending position and prepares to raise the foot to continue running or walking, the biasing means straightens out from its flexed position at an angle to the user's body substantially similar to the angle the straightened leg forms with the body. The biasing means straightens out in response to the straightening or extension of the leg and the movement of the arm and hand. As the biasing means straightens out it releases its stored energy thereby boosting the body in its upward and forward extension. This assistance rendered to the leg in an upward and forward direction allows the body muscles to contract and tighten to a lesser extent while still achieving the desired body movement. Since the leg and biasing means when straightened are slightly forward of a 90-degree angle taken with the ground, the body is caused to move in an upward and forward direction. The extension of the device through the biasing means helps raise the body upward increasing the potential energy.

These movements are alternatively repeated between the pole, leg, arm and hand of the right side of the body and the pole, leg, arm and hand of the left side of the body. Pressure is alternatively applied and released upon the biasing means between a right-sided device and a left-sided device so that as the pressure is applied upon a device on one side of the body, the pressure is released at approximately the same time upon the device on the other side. Thus, it is to be understood that this invention encompasses the use of two devices, one on each side of the body. In this manner, the device assists the user in the repeated and alternating flexing and extending of the legs in running, walking and jumping. It is also to be understood that a user could use the device only on one side of his body. This may be desirable for individuals who have a weakened or injured condition on only one side of their body or leg. Thus, the device can be used in pairs or singly.

In order for the pole to absorb the energy and ultimately return the energy, the arms and hands must be stiff and taut enough to transmit the load of the body. Therefore, the operation of this device requires the hand and arm muscles to be alternatively tightened and relaxed in order to achieve the flexing and straightening of the biasing means. The operation of the device also causes physical exercise for the arm and hand muscles. A 135-pound person in average physical condition can carry a load of 30–40 pounds per hand. A user can increase the energy transferred to the biasing means and reduce the muscular contraction necessary to transmit such force by moving the hand to a position on the handle further away from the connection between the handle and biasing means, thereby increasing the mechanical advantage. As indicated hereinabove, when the biasing means is an elongated pole, the pole cross-section, pole thickness and pole material, as well as the adjustment of the handle height, can all render the energy transferred to the pole by the user easier to accomplish with less arm and hand effort.

During jumping, the device is used in a similar fashion except the biasing means or poles are aligned to correspond with the direction of the extended legs. That is, the biasing means are kept in a more vertical direction without needing much forward or backward rotation. The discharge of the stored energy in the biasing means obtained from landing is directed to assist the jumper in his or her vertical ascent allowing a jumper to obtain a particular jump height with less expenditure of muscular effort. Landing is accomplished with less of a load and stress to body. The shoe extension 2 can have a connecting bridge 7 which permits the impact element or elements to be positioned below the sole of the shoe when the shoe is off the ground. Upon landing, the impact element would reach the ground surface before the entire foot and augment the energy absorption and shock absorption. The device can be used for jumping in place or jumping to different locations.

In a controlled use of the device for jumping from one location to another the device was observed to decrease the physical effort needed to jump from one location to another. Using the device on each side of the body so that each foot has a biasing means attached to a shoe extension, an individual jumped a distance of fifteen meters. With the use of the device the distance of fifteen meters was reached after eight and one-half jumps. Without the device the distance was reached only after ten jumps.

In another controlled use of the device for running the physiological effort of the user of the device was observed to decrease with the use of the device. The device was used on only one side of the body to run 400 meters in a time range of about $2\frac{1}{2}$ to $2\frac{3}{4}$ minutes. The starting pulse rate was measured to be 80 pulses per minute and upon completion of running the distance with the device was measured at 119 pulses per minute. Without the device the pulse rate was measured to be 138 pulses per minute upon completion of the distance when the starting pulse rate was 80 pulses per minute.

In general, the device assists a person during the repeated flexing and extending of the legs that is involved in running, walking and jumping. It will also be understood that the invention will assist individuals in a weakened physical condition, those in need of reducing stress to body joints, muscles, bones and other parts of the body and those individuals in need of physical rehabilitation. The invention enables individuals to engage in physical exercise and activity with reduced stress to various parts of the human body.

While specific embodiments of the device for assisting running, walking and jumping have been shown and described, it should be apparent that certain changes, alterations and substitutions can be made in the materials, design and dimensions of the elements therein and that such changes are within the scope and spirit of the invention.

I claim:

1. A hand held device for assisting a person in walking, running, or jumping comprising:

an elongated biasing means having a top end and a ground end and adapted to be positioned adjacent to the person's leg extending from said top end near the person's hip area to said ground end adjacent to the person's shoe;

a handle fixedly secured to said biasing means; and a shoe extension having a flexible bridge and means for attaching to the shoe, said flexible bridge having one end swingably attached to said shoe attachment means, and extending to a swingable attachment with said ground end of said biasing means whereby the heel of the shoe can lift off the ground while pressure from the person's body applied to said handle is supported by said biasing means and keeps said shoe extension in a fixed position relative to the ground and causes said biasing means to absorb the impact of landing and to store the energy released as the shoe lands upon the ground.

2. The device of claim 1 wherein said biasing means is an elongated, flexible pole adapted to be positioned adjacent to the outer side of the person's leg.

3. The device of claim 2 wherein said pole is made from a material selected from the group consisting of composites of Kevlar, composites of graphite, and composites of fiberglass.

4. The device of claim 1 wherein said biasing means is a torsional spring.

5. The device of claim 1 wherein said biasing means is a compression spring.

6. The device of claim 1 wherein said biasing means is a compression spring having a rigid supporting member positioned between said compression spring and said ground end.

7. The device of claim 1 wherein said swingable attachment between said flexible bridge and said ground end of the biasing means comprises a cylindrical bar secured at substantially right angles to the longitudinal axis of said biasing means and impact absorbing means wherein said cylindrical bar is retained in said impact absorbing means so that said biasing means is able to rotate along an axis of rotation along the length of said cylindrical bar.

8. The device of claim 1 wherein the shoe extension is attached at a point on the outer side of the shoe at a location substantially adjacent to a toe area of the shoe so that a heel of the shoe can be raised while pressure upon the ground end of the biasing means holds the impact absorbing means to the ground.

9. The device of claim 1 further including impact absorbing means positioned and secured around said ground end of said biasing means and wherein said shoe extension is attached at a point on the outer side of the shoe at a location substantially adjacent to the toe area of the shoe so that the heel of the shoe can be raised while pressure upon the ground end of the biasing means holds said impact absorbing means to the ground.

10. The device of claim 1 wherein said flexible bridge extends along the outer edge of the shoe from the shoe attachment means to a location adjacent to the person's ankle.

11. The device of claim 1 wherein said flexible bridge of said shoe extension is a wire-like frame.

12. The device of claim 1 wherein said flexible bridge of said shoe extension is a strip-like member.

13. The device of claim 1 wherein said handle protrudes at an acute angle from said biasing means so that when the biasing means is flexed said handle moves to a position substantially parallel to said ground surface.

14. The device of claim 1 wherein said handle is slidably adjustable along the length of said elongated biasing means and is adjustable around said elongated biasing means in a circular plane and wherein said handle is fixably secured to said elongated biasing means by locking nuts applying pressure onto said biasing means by a plunger screw.

15. The device of claim 1 wherein said handle is fixedly secured to said elongated biasing means by self-locking means as pressure is applied on said handle.

16. A method of assisting a person in running or walking comprising:

providing a hand held device comprising: an elongated biasing means having a top end and a ground end and positioned adjacent to the person's leg extending from said top end near the person's hip area to said ground end adjacent to the person's shoe; a handle fixedly secured to said biasing means; and a shoe extension having a flexible bridge and means for attaching to the shoe, said flexible bridge having one end swingably attached to said shoe attachment means, and extending to a swingable attachment with said ground end of said biasing means whereby the heel of the shoe can lift off the ground while pressure from the person's body applied to said handle is supported by said biasing means and keeps said shoe extension in a fixed position relative to the ground and causes said biasing means to absorb the impact of landing and to store the energy released as the shoe lands upon the ground;

keeping arms and hands taut to apply pressure upon said handle to cause said biasing means to flex upon the landing of a foot to which the biasing means is connected by way of said shoe extension thereby reducing the stress of landing and storing energy;

pivoting said biasing means as the person moves forward while the shoe is in a stationary position on the ground; and releasing said pressure on said biasing means while keeping the arms and hands taut to enable said biasing means to straighten out and discharge said energy as the foot leaves the ground and the leg is extended thereby assisting the upward and forward movement of walking or running.

17. The method of claim 16 wherein said hand held device is defined as a first device further comprising:

providing a second hand held device, said second device being substantially the mirror image of said first device and being positioned adjacent to the person's other leg; and alternating the application of said pressure and said release of said pressure upon said biasing means between said first device and said second device so that as said pressure is applied upon one of said devices said pressure is released at approximately the same time upon the other of said devices.

18. A method of assisting a person in jumping comprising:

providing a hand held device comprising: an elongated biasing means having a top end and a ground end and positioned adjacent to the person's leg extending from said top end near the person's hip area to said ground end adjacent to the person's shoe; a handle fixedly secured to said biasing means; and a shoe extension having a flexible bridge and means for attaching to the shoe, said flexible bridge having one end swingably attached to said shoe attachment means, and extending to a swingable attachment with said ground end of said biasing means whereby the heel of the shoe can lift off the ground while pressure from the person's body applied to said handle is supported by said biasing means and keeps said shoe extension in a fixed position relative to the ground and causes said biasing means to absorb the impact of landing and to store the energy released as the shoe lands upon the ground;

keeping arms and hands taut to apply pressure upon said handle to cause said biasing means to flex upon the landing of a foot to which the biasing means is connected by way of said shoe extension thereby reducing the stress of landing and storing energy; and releasing said pressure on said biasing means while keeping the arms and hands taut to enable said biasing means to straighten out and discharge said energy as the foot leaves the ground and the leg is extended thereby assisting the upward movement of jumping.

19. The method of claim 18 further comprising pivoting the biasing means in a desired direction prior to said straightening out of said biasing means and extension of said leg to assist in said desired direction of movement.

* * * * *